United States Patent [19]

McCormick

[11] 4,070,133

[45] Jan. 24, 1978

[54] PUMP COMPRESSOR UNIT FOR USE WITH PUMPING DRAFT BEER

[76] Inventor: Homer McCormick, 5645 Emerson, Morton Grove, Ill. 60053

[21] Appl. No.: 656,185

[22] Filed: Feb. 9, 1976

[51] Int. Cl.[2] ..... F04B 49/00; B67D 1/12; B67D 1/04

[52] U.S. Cl. ..... 417/38; 417/557; 137/212; 222/400.8

[58] Field of Search ..... 417/26, 412, 44, 551; 137/212; 222/400.8

[56] References Cited

U.S. PATENT DOCUMENTS

| | | | |
|---|---|---|---|
| 1,981,611 | 11/1934 | Cappa | 137/212 |
| 1,988,334 | 1/1935 | Risinger | 222/400.8 |
| 2,085,274 | 6/1937 | Rutt et al. | 137/112 |
| 3,204,857 | 9/1965 | Weller | 417/557 |
| 3,308,990 | 3/1967 | Klasson et al. | 137/212 |
| 3,650,639 | 3/1972 | Greene et al. | 417/413 |
| 3,825,154 | 7/1974 | Jaeger | 222/400.8 |
| 3,953,152 | 4/1976 | Sipin | 417/411 |

*Primary Examiner*—William L. Freeh

[57] ABSTRACT

An air supply unit provides high pressure moisture-free air in the dispensing of beverages. Components are housed in a portable cabinet and include a compressor and an automatic air pressure switch to switch on the compressor and begin air flow when system pressure falls below a pre-set level. A check valve is located in the high pressure line adjacent the compressor to maintain line pressure when the compressor is off. A small air bleed opening is located between the check valve and the compressor to allow compressed air to move through the air line yet bleed residual pressurized air to prevent stalling of the compressor which could occur if high pressure air was present in the compressor when it is restarted. The high pressure air discharge line includes a dump-check valve to permit high pressure air to be manually bled from the system before the air lines are disconnected and to prevent back flow of fluid into the air supply unit.

5 Claims, 4 Drawing Figures

FIG.1
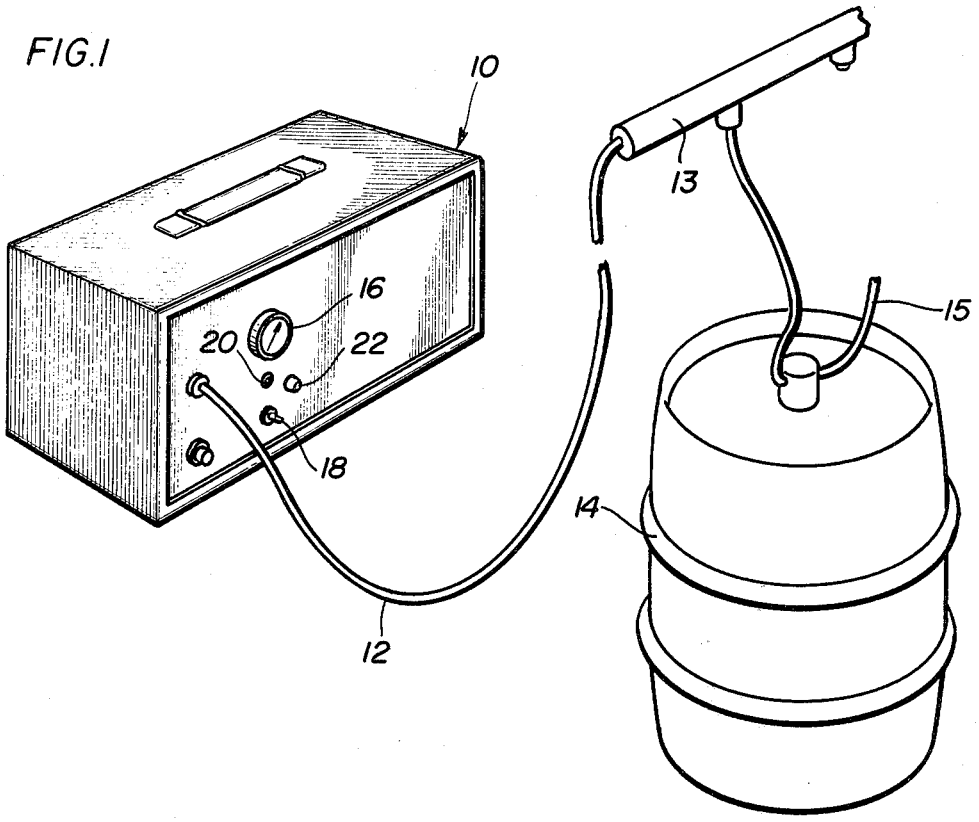
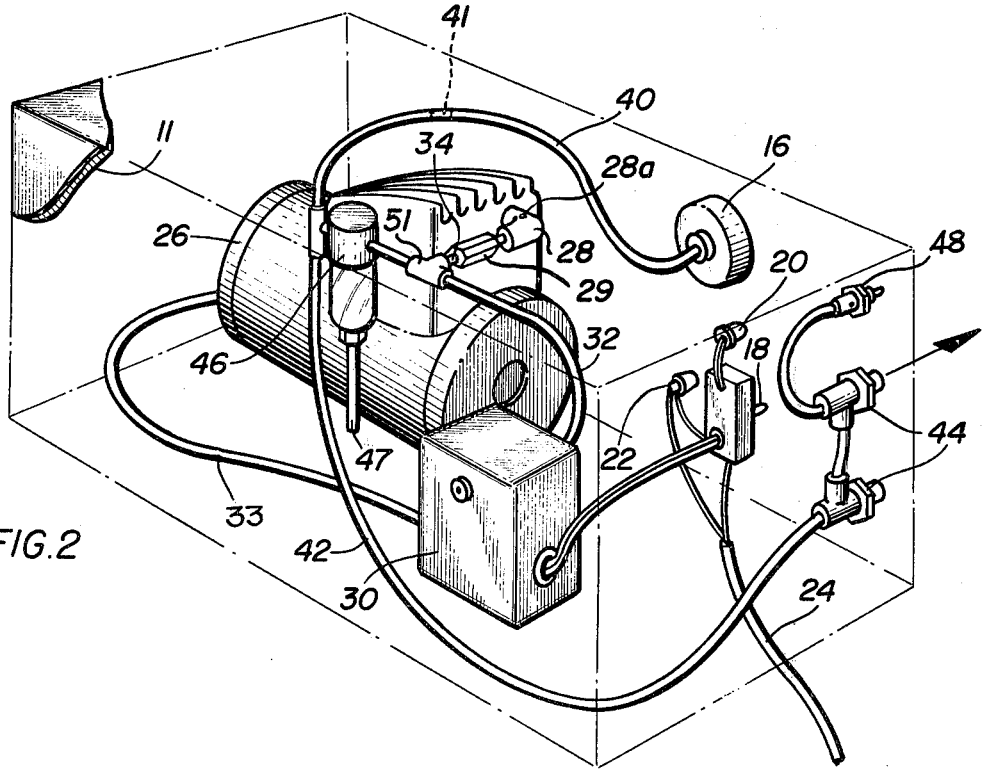
FIG.2

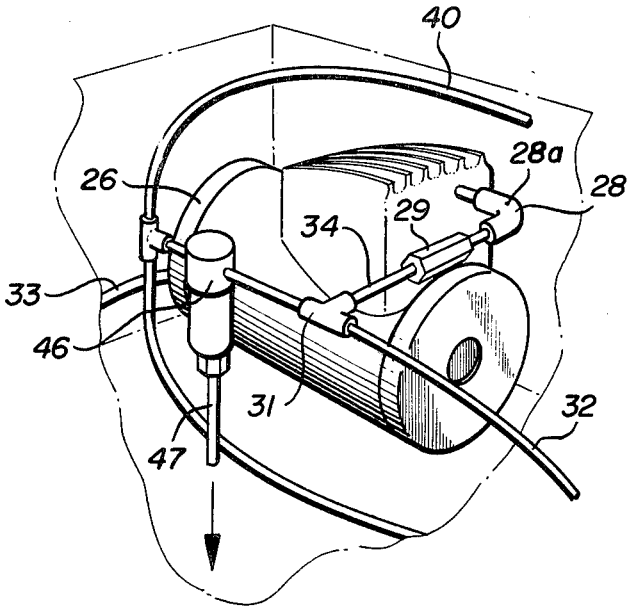
FIG.3
FIG.4
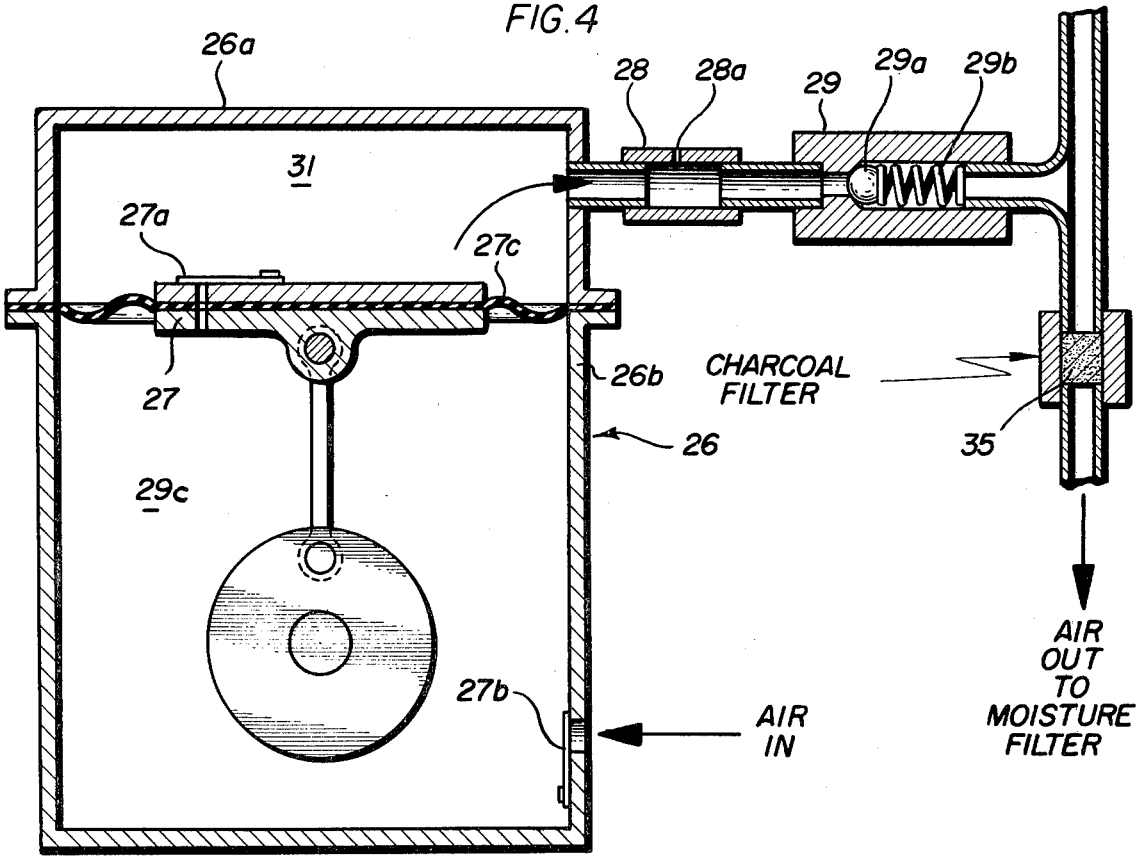

PUMP COMPRESSOR UNIT FOR USE WITH PUMPING DRAFT BEER

BACKGROUND OF THE INVENTION

1. Field of the Invention

This invention pertains to a supply unit for supplying pressurized air for dispensing of beverages.

2. Description of the Prior Art

Prior art air pressure systems provide air to beverage dispensers by storing high pressure air cylinders in the vicinity of the beverage containers. As air is drawn from the cylinders to force fluid from the beverage containers, pressure within the cylinders decreases and results in a slower beverage flow. Additionally, these air pressure tanks require recharging, are cumbersome to handle and occupy considerable space.

SUMMARY

The present invention provides a portable, compact air supply unit for dispensing carbonated or other beverages stored under pressure. The electrically operated air supply unit provides a highly portable, compact pressure pack or module with a cabinet having an inner, fire retardant and sound absorbing lining. The cabinet contains a compressor and an associated electrical and pneumatic air control devices that initiate operation of the compressor when the air pressure in the beverage tank falls below a pre-set level. A pressure sensing switch is located in the air line connected to the beverage dispenser to turn the compressor on when system pressure falls below the pre-set level and turn the compressor off when the desired pressure is reached.

A one-way check valve is mounted in the high pressure line coming from the compressor. Between the check valve and compressor is a bleed opening to release residual pressure from the compressor.

In operation, an air pressure line is connected between the beverage dispenser and the portable air supply unit. A filter for removing moisture and a charcoal filter for removing odors and gasses which are in the high pressure air line. An air pressure switch monitors the beverage dispenser air pressure and is electrically coupled to turn the compressor on as more pressure is required. After the on-off control switch is turned to the "on" position the unit will operate automatically and maintain a pre-set pressure within the beverage container that can be observed on a pressure gauge.

These and other features and advantages of the invention will become apparent to those skilled in the art from the following description, attached drawings and appended claims.

BRIEF DESCRIPTION OF THE DRAWINGS

FIG. 1 is a pictorial illustration of the control cabinet or module of the air supply unit and an associated beverage container; and, FIG. 2 is a pictorial illustration of the internal components in the air supply unit.

FIG. 3 shows a fragmentary view of several of the internal components in the art supply unit; and, FIG. 4 shows a schematic cross section of the compressor shown in FIGS. 2 and 3.

DETAILED DESCRIPTION

Referring now to the drawings, and in particular to FIG. 1, there is shown the air supply cabinet module 10. The inside of cabinet 10 is lined with a sound absorbing, flame retardant material 11. The bottom of cabinet 10 may be perforated or louvered to admit air. Extending from the cabinet 10 is a high pressure air feed line 12 that may be coupled to a header pipe 13 to feed a single or plurality of beverage dispensers 14. High pressure air flows through line 12 into the dispenser 14 to force beverage into liquid line 15 from the container as needed.

The air supply unit 10 may include a housing or a case having a switch 18 for turning the unit on and off. Light 20 serves as a visual indicator to show when the unit is switched on. A fuse and socket 22 may be conveniently located in the cabinet faceplate for easy replacement. Pressure gauge 16 is mounted on the face of the cabinet and indicates pressure in the air feed line 12 which also corresponds with air pressure within the beverage container 14.

Electrical power is provided via power line 24 (FIG. 2) which connects with the fuse 22 and switch 18.

Air pressure is provided by compressor 26 stored within the cabinet 10 and may be of any convenient design needed in the dispensing of beverages.

FIG. 4 shows a schematic cross section of the compressor 26. Piston head 27 reciprocates up and down creating pressure in the compression chamber 31 on the upstroke and admitting air from low pressure chamber 29 to compression chamber 31 on the downstroke. Reed type valve **27*a* alternately closes its associated port when the piston 27 rises, and opens when the piston is pulled downward. Flexible disc 27*c* maintains an airtight seal between lower chamber 29 and upper chamber 31**.

Chamber valve **27*b* controls the flow of ambient air into lower chamber 29. Thus as piston 27 rises to compress air in chamber 31 outside air is pulled into the chamber 29 through valve 27*b*. Air is drawn into chamber 29 in such a fashion until piston 27 descends at which time piston valve 27*a* opens and chamber valve 27*b* closes. This changing of the valve conditions when the piston moves downward compresses air in chamber 29*c* until valve 27*a* is forced open to admit air to chamber 31. Of course, compression of air in chamber 29 closes valve 27*b***.

Check valve 29 (FIG. 4) is of a conventional design and may incorporate a ball **29*a* urged in one direction by compression spring 29*b*. Check valve 29 opens to permit a pre-set pressurized air to flow through. No air flows into the system air lines until enough pressure is developed by compressor 26 to push air through check valve 29. When the desired system air pressure is reached, compressor 26 shuts off and check valve 29** maintains system pressure by preventing the back flow of air into the compressor.

The elbow 28 contains a small opening **28*a* that slowly releases pressurized air from the compressor chamber 31 and from the section of tubing between check valve 29 and compressor 26**.

Opening **28*a* is very small and does not interfere with pressurization of air or air flow yet provides an air bleed feature to prevent stalling of the compressor 26 that could occur if pressure in chamber 31 exceeded pressures in chamber 29*c* during the piston downstroke which would prevent valve 27*a* from opening to admit air to the compression chamber 31**.

Electrical line 33 conducts electricity between the compressor 26 and an adjustable air pressure sensing switch 30. Air switch 30 is of the type manufactured by Furnas Electric, No. 69 G C8, or the like. As shown in FIG. 2, the air pressure sensing switch 30 is placed electrically in series between the compressor 26 and the on-off switch 18 to cycle the compressor on and off, depending on air pressure needed in the beverage container 14. The sensing switch 30 monitors air line pressures through a pneumatic coupling with the compressor provided by hose 32.

The high pressure outlet of the compressor 26 is coupled with a header pipe unit 34 that feeds high pressure into the tee 51 for distribution in three directions (FIG. 2). Hose 32 feeds high pressure air to the air pressure sensing switch 30. Hose 40 is connected with the pressure gauge 16 to indicate the pressure of air being supplied and/or the air pressure within the beverage container 14. A section of cotton 31 or other suitable vibration snubber is attached to the pressure gauge line 40. Feed line 42 may connect with more than one outlet coupling as shown by couplings 44.

Dump and air release valve 48 connects with the air couplings 44 to allow air pressure to be released from the air lines when the unit is being serviced or the like. Air couplings 44 also function as check valves to prevent back flow of fluid into the air compressor unit 26 if a malfunction should occur, such as extreme heating of beverage dispensers 14, causing pressure in the beverage dispenser 14 to exceed pressure within the air unit 10.

Moisture filter 46 is connected to remove moisture and other airborne particles from the air line in order to supply moisture-free non-diluting air to the beverage container 14. Drain tube 47 is used to direct moisture to a collecting point or discharge chain.

As shown in FIG. 4 charcoal filter 35 is located in the air line between check valve 29 and moisture filter 46. Thus moist air can pass through charcoal filter 35 to aid in cleaning charcoal.

In operation, beverage dispensing tanks, kegs 14 or the like may be connected to air couplings 44 after the pressure sensing switch 30 is adjusted to a predetermined level, for example, between 14 and 18 lbs. per square inch, gauge, (p.s.i.g., that is, 14–18 psi above atmospheric pressure) for most beverages. The switch 30 contains an air pressure sensing element coupled with switching contacts that will close to operate the compressor 26 when pressure in the attached beverage container falls below the pre-set pressure. This control provides for automatically maintaining a minimum air pressure within the beverage dispensing container 14. As system pressure rises, it can be observed on pressure gauge 16. When a high pressure limit is reached, the air switch 30 operates to release excessive pressure and shuts off the compressor 26. Consequently, the air pressure control unit operates quietly, automatically and safely.

The foregoing description and drawings merely explain and illustrate the invention and the invention is not limited thereto, except insofar as the appended claims are so limited, as those who are skilled in the art who have the disclosure before then will be able to make modifications and variations therein without departing from the scope of the invention.

What is claimed is:

1. A portable, compact air supply unit for providing a controlled amount of pressurized air in the dispensing of beverages or fluids, and including:

a container adapted to be portably transported; and having disposed therein the following:

a compressor;

air distribution line means connected to said compressor means for feeding pressurized air to at least one outlet means located on said container;

a check valve located in a first portion of the distribution line means and having means for allowing air flow in one direction and preventing air flow in the opposite direction through the check valve;

air bleed means including an opening upstream of the check valve for releasing residual pressure from the first portion of the air distribution line means;

pressure switch means located in a second portion of the distribution line means and including means electrically coupled with the compressor to cycle the compressor on and off in response to air pressure in the air distribution line means; and filter means located in a third portion of the air distribution line means and having means for removing moisture from the pressurized air.

2. The air supply unit of claim 1, wherein said means for feeding pressurized air from the air supply unit comprises:

coupling means for attachment of air lines;

air check valve means; and, an air bleed for selectively releasing air pressure from the air distribution line means.

3. The air supply unit of claim 1, wherein said filter means includes:

charcoal means for removing gaseous airborne substances from the pressurized air; and, said means for mounting said charcoal means upstream of the means for removing moisture.

4. The air supply unit of claim 1, and:

a pressure indicating guage;

a pneumatic line coupling the pressure guage to the air distribution line means;

damper means associated with said pneumatic line; and, switch means for manually turning the air supply unit on and off.

5. The air supply unit of claim 1 wherein said cabinet includes fire retardant means lining the inside thereof.

* * * * *

UNITED STATES PATENT OFFICE
CERTIFICATE OF CORRECTION

Patent No. 4,070,133 Dated January 24, 1978

Inventor(s) Homer McCormick

It is certified that error appears in the above-identified patent and that said Letters Patent are hereby corrected as shown below:

Column 1, line 26, following "and" delete "an"; Column 3, line 37, following "cleaning" insert --the--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*